United States Patent [19]

Parizet

[11] Patent Number: 4,458,553

[45] Date of Patent: Jul. 10, 1984

[54] WINDOW GLASS RAISING ARM, IN PARTICULAR FOR AN AUTOMOBILE VEHICLE

[75] Inventor: Roger Parizet, Bonnee, France

[73] Assignee: Compagnie Industrielle des Mecanismes en abrege C.I.M., France

[21] Appl. No.: 355,959

[22] Filed: Mar. 8, 1982

[30] Foreign Application Priority Data

Mar. 16, 1981 [FR] France ..... 8105180

[51] Int. Cl.[3] ..... G05G 1/04

[52] U.S. Cl. ..... 74/519; 74/545; 403/274

[58] Field of Search ..... 49/374, 349, 350; 74/543, 523, 519, 588, 545; 403/274, 284; 16/121, DIG. 41, DIG. 24, DIG. 30, DIG.31

[56] References Cited

U.S. PATENT DOCUMENTS

| | | | |
|---|---|---|---|
| 1,278,441 | 9/1918 | Cunningham | 403/274 |
| 1,667,031 | 4/1928 | Carroll et al. | 49/350 |
| 1,736,703 | 11/1929 | Rauser et al. | 49/350 |
| 1,753,700 | 3/1930 | Graff et al. | 74/545 |
| 2,899,832 | 8/1959 | Meyer | 49/349 |
| 2,903,909 | 9/1959 | Ergell | 74/588 |
| 3,016,766 | 1/1962 | Hoyler | 74/588 |
| 3,130,443 | 4/1964 | Tonelli | 403/274 |
| 3,466,803 | 9/1969 | Packett | 49/374 |
| 4,188,800 | 2/1980 | Fujita et al. | 403/274 |
| 4,378,174 | 3/1983 | Hesse | 403/274 |

FOREIGN PATENT DOCUMENTS

| | | | |
|---|---|---|---|
| 68571 | 2/1941 | Czechoslovakia | 403/274 |

*Primary Examiner*—Kenneth Dorner
*Assistant Examiner*—Anthony W. Raskob, Jr.

[57] ABSTRACT

This window glass raising arm comprises a ribbed link of thin sheet metal having an end portion which is formed over onto a conical base of a roller which is in one piece with the base and of plastics material. This provides a simple and cheap assembly which is nonetheless suitably efficient.

5 Claims, 5 Drawing Figures

WINDOW GLASS RAISING ARM, IN PARTICULAR FOR AN AUTOMOBILE VEHICLE

The present invention relates to arms for raising window glasses, in particular for automobile vehicles, of the type comprising a link which carries a roller adjacent one end of the link. This roller is adapted to cooperate with a groove of complementary shape provided either in the base of a window glass or in a slideway for guiding the latter.

The relatively great thickness (of the order of 25 to (30/10 mm) of sheet metal usually employed for constructing the links of window glass raising arms requires the mounting of the roller on the link by a riveting operation. This does not allow employing a plastics material for the spindle of the roller since the riveting assembly would not be sufficiently strong.

Recent efforts for lightening window glass raisers have resulted in the adoption of much thinner sheet metal, of the order of 12 to 15/10 mm, for constructing the links.

An object of the invention is to provide an arrangement which takes advantage of this decrease in thickness for lightening the arm and reducing the cost of the latter.

According to a first embodiment, the invention consequently provides a window glass raising arm of the aforementioned type, in which the roller is formed by a body journalled on a journal, and the latter comprises an enlarged base over which the corresponding end portion of the link is formed.

Indeed, this manner of connecting the journal and link is sufficiently strong, even when the journal of the roller is of plastics material.

According to a second embodiment, the invention also provides a window glass raising arm of the aforementioned type, wherein the roller is fixed to the link by a forming over of the corresponding end portion of the link onto an enlarged base rigid with the body of the roller, the roller and its base preferably forming a single member of plastics material.

In an advantageous embodiment, the base has a stud received in a complementary aperture in the end portion of the link. Indeed, it is then possible to employ, for forming the link over the base, merely claws or a flange projecting from the periphery of the end portion of the link (which does not weaken this end portion), since the stud prevents any tilting of the roller outwardly of the link.

The invention will be described hereinafter in more detail with reference to the accompanying drawing which illustrates solely two embodiments of the invention.

Figure 1:
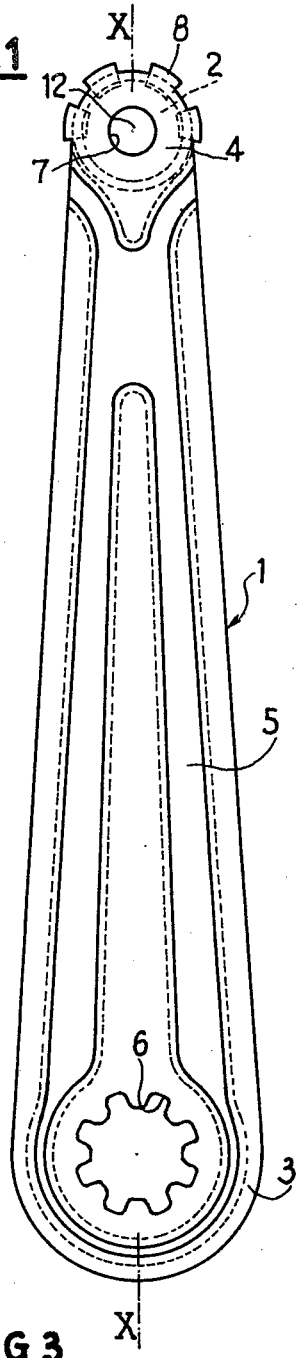
FIG. 1 is a front elevational view of a window glass raising arm according to the invention.
Figure 2:
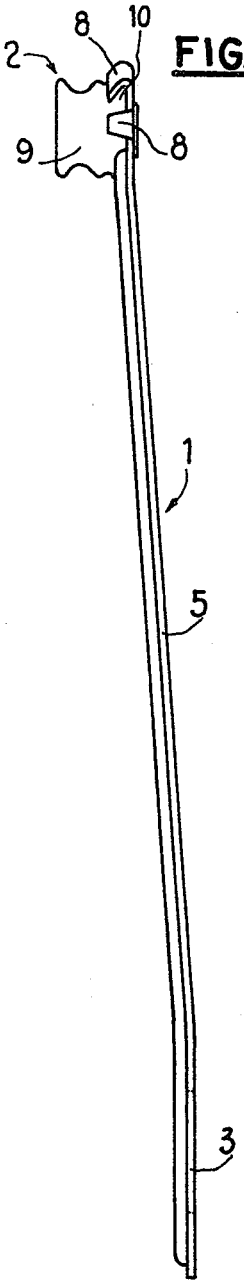
FIG. 2 is a side elevational view of this arm.

The window glass raising arm shown in FIGS. 1 and 2 comprises two members, namely a link 1 of thin sheet metal 12/15 mm thick and a single-piece roller 2 of plastics material, for example of acetal resin which is fixed to this link.

The link 1, which is symmetrical relative to a horizontal axis X—X, comprises a large circular end portion 3 and a small circular end portion 4 which are interconnected by a body 5 whose edges define tangents common to the two end portions 3 and 4.

The end portion 3 has a splined centre aperture 6 for mounting the link on a driving shaft (not shown), or on another similar link (not shown) through a section of a splined shaft. The end portion 4 is provided with a centre circular aperture 7 and a plurality of radially extending tabs 8 which project from the periphery of the end portion 4. The body 5 and the end portion 3 are provided with suitable stiffening ribs.

The roller 2 (FIGS. 2 and 3) comprises a roller body 9 whose diabolo-shaped meridian contour is complementary to the contour of a groove provided in the base of the window glass or in a slideway (not shown) for guiding the window glass, in which groove this body is adapted to move. The body 9 is extended at one end by a base 10 which is moulded therewith and has a roughly conical shape and a planar end surface 11 of circular shape and of a diameter roughly equal to the diameter of the end portion 4 of the link 1. Projecting from this surface 11 is a centre stud 12 of the same diameter as the aperture 7 of the link and surrounded by a circular groove 13 which imparts elasticity to the base 10. Extending from the end surface 14 of the roller opposed to the surface 11 is a lightening blind bore 15.

For the purpose of assembling the roller 2 and the link 1, it is sufficient to apply the surface 11 of the roller against the end portion 4 of the link, the stud 12 entering the aperture 7 and thereby centering the roller, and to form over all the tabs 8 onto the base 10 so as to hold the latter in position on the link. The assembly is very rigid notwithstanding the flexibility of the plastics material of the roller 2.

Figure 3:
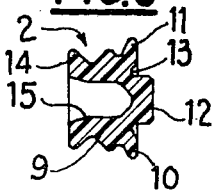
FIG. 3 is an axial sectional view of the roller of the arm.
Figure 4:
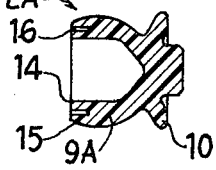
FIGS. 4 and 5 are views similar to FIG. 3 of two modifications of the roller.

FIG. 4 shows a roller 2A which differs from the roller 2 of FIG. 3 only in respect of the meridian contour of its body 9A. Indeed, this contour is roughly spherical and terminates at the end opposed to the base 10 in an annular lip portion which is defined by a circular groove 16 formed in the end surface 14.

In operation, the roller 2A moves in a groove of complementary shape, and the lip portion 15 takes up the play and reduces noise.

Figure 5:
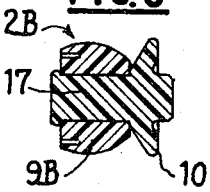

In the embodiment shown in FIG. 5, the base 10 is one end of a journal 17 of plastics material on which journals (or, in accordance with a modification, not shown, swivels) the body 9B of the roller 2B which is also of plastics material. However, the assembly of the arm is then more complicated since there is an additional member and the cost of the complete arm is higher.

In each case, the tabs or claws 8 of the link may be replaced by a circular flange which is formed over onto the conical surface of the base 10 by a rolling operation.

Having now claimed my invention what I claim as new and desire to secure by Letters Patent is:

1. A window glass raising arm for an automobile vehicle comprising:

a link made of sheet metal and having a driven end portion, a roller end portion and an elongated body portion therebetween;

a roller made of plastic and including a journal having an enlarged base at one end thereof;

said base having a substantial conical shape; and said roller end portion of said link including a series of tabs projecting from a periphery thereof, which said tabs are folded over onto a conical surface of said base to secure said roller to said link.

2. The window glass raising arm as set forth in claim 1, wherein said roller end portion of said link includes an opening therethrough and said base has a stud which extends therefrom for receipt within said opening of said roller end portion.

3. The window glass raising arm as set forth in claim 2, wherein said base includes a recess surrounding said stud to insure the flexibility of said base as said series of said tabs are formed thereover.

4. The window glass raising arm as set forth in claim 1, wherein said roller includes a body surrounding said journal having a contour which is complementary to a contour of a groove provided in a base of a window glass.

5. The window glass raising arm as set forth in claim 4, wherein said journal is integrally formed with said base and said body is separate from said journal of said roller and mounted for rotation thereon.

* * * * *